United States Patent [19]

Bennett et al.

[11] Patent Number: 4,545,499

[45] Date of Patent: Oct. 8, 1985

[54] CONTAINER CLOSURE

[75] Inventors: Julian Bennett; Bernard Salsby, both of Colchester, England

[73] Assignee: National Plastics Limited, Colchester, England

[21] Appl. No.: 678,387

[22] Filed: Dec. 6, 1984

Related U.S. Application Data

[63] Continuation of Ser. No. 461,263, Jan. 26, 1983, abandoned.

[30] Foreign Application Priority Data

May 20, 1982 [GB] United Kingdom ..... 8214691

[51] Int. Cl.[4] ..... B65D 53/00

[52] U.S. Cl. ..... 215/352

[58] Field of Search ..... 215/341, 343, 350, 352, 215/344

[56] References Cited

U.S. PATENT DOCUMENTS

| | | | |
|---|---|---|---|
| 2,393,751 | 1/1946 | Chott | 264/274 X |
| 3,189,209 | 6/1965 | Owens | 215/350 X |
| 3,381,351 | 5/1968 | Szwargulski | 264/268 X |
| 4,331,249 | 5/1982 | Banich | 215/352 X |
| 4,378,893 | 4/1983 | Wilde et al. | 215/343 X |

FOREIGN PATENT DOCUMENTS

| | | | |
|---|---|---|---|
| 47374 | 6/1971 | Australia | 215/352 |
| 2451324 | 10/1980 | France . | |
| 464721 | 12/1968 | Switzerland | 215/341 |

*Primary Examiner*—Donald F. Norton

*Attorney, Agent, or Firm*—Richard D. Weber

[57] ABSTRACT

A container closure, adapted for the formation of a sealing gasket of synthetic plastics material in situ, includes an end wall, a continuous side wall upstanding from the end wall and enclosing an inner surface of the end wall, and a plurality of spaced-apart retaining members upstanding from the inner surface of the end wall within the boundary of the side wall, each of the retaining members having a retaining surface obliquely inclined above the inner surface of the end wall. Gasket material, or a pre-cursor material, in liquid state can be introduced into the closure and can flow at least partly around the retaining members and beneath the obliquely inlined retaining surfaces to be retained, upon solidification of the gasket material, in the closure.

13 Claims, 1 Drawing Figure

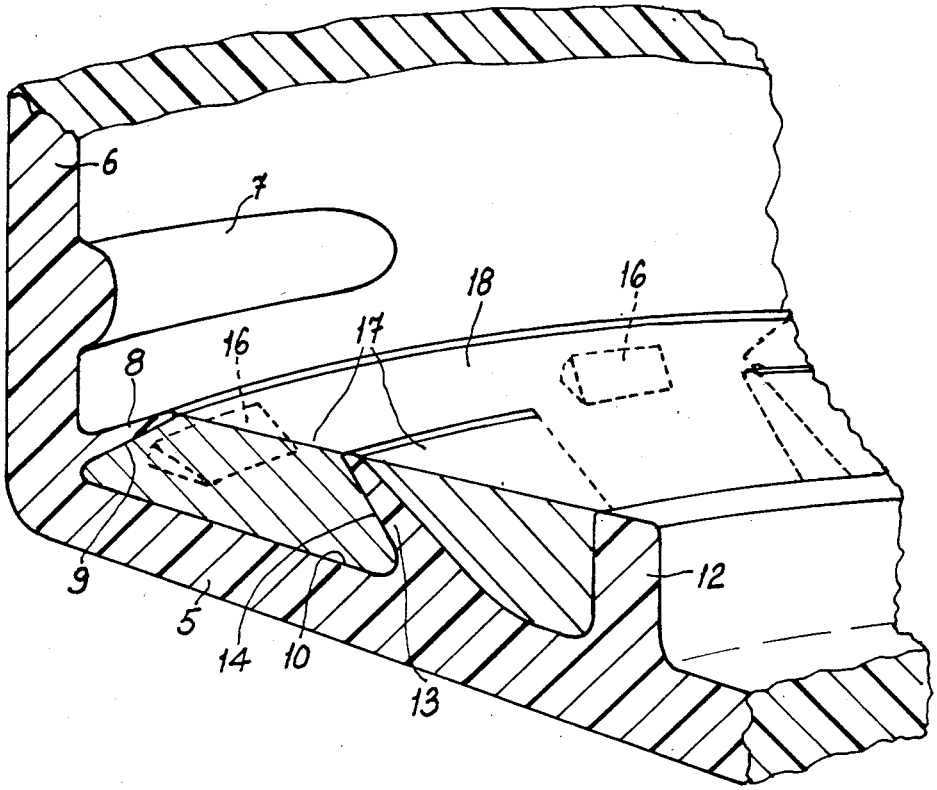
6
7
18
16
16
17
8
9
5
14
10
13
12

CONTAINER CLOSURE

This is a continuation of copending application Ser. No. 461,263 filed on Jan. 26, 1983, now abandoned.

This invention relates to a container closure.

Plastics screw closures are sometimes used on glass or plastics containers. Many of the closures have plug seals which form a seal on the inside of the neck of the container but in the case of containers with thin walls the use of plug seals can lead to splitting of the container wall. It is also generally necessary to keep to tighter tolerances on the bore of bottles used with plug seal closures. It is therefore desirable for the closure to seal on the rim of the opening in the container.

The closure may carry a gasket to provide a seal with the rim of the container opening.

It is advantageous to form such a gasket in situ in the closure but the provision of a satisfactorily shaped recess in the closure in order to achieve an adequate adhesion between the gasket and the closure, especially when made of a synthetic plastics material, has not proved easy. The object of the present invention is to provide a closure of hydraulic plastics material so shaped that a gasket can be formed in situ in the closure and will be adequately retained in the closure.

According to the invention, a container closure is shaped to allow a gasket of synthetic plastics material to be formed in situ in the closure, the closure including a plurality of retaining members each having a retaining surface which is obliquely inclined above an inner surface of the closure, whereby gasket material or pre-cursor material in liquid state can be introduced into the closure and can flow around or partly around said retaining members and beneath said retaining surfaces to be retained, upon solidification, in the closure.

In this specification, the terms "upwardly" and "downwardly" are used in relation to closures in the sense that the upper end of a closure is the open end intended to be received on the neck of a container and the lower end of a closure is the closed end thereof. These terms thus apply naturally to dispositions in relation to a closure in the attitude in which the closure would normally be held after removal from a container, the closure than having its open end uppermost so that the interior of the closure can be inspected.

Advantageously, said retaining members are located in a region of the closure adapted to receive the gasket and bounded on its outer periphery by an outer annular boundary element overhanging part of said inner surface.

An inner annular boundary element within the outer boundary element may constitute an inner limit on the closure for the gasket material and the inner annular boundary element may also overhang part of said inner surface of the closure.

The retaining members may be distributed at various distances from the centre of the closure or they may be located on a circle with its centre on the central axis of the closure. Preferably no retaining members are located within an annular region of the closure inner surface intended to underlie the annular region of the gasket which is to form a seal with the rim of a container neck.

The inner surface of the closed end of the closure between the inner and outer boundary elements may be roughened to provide a key for the synthetic plastics material of the gasket.

The invention includes a closure as described herein with a gasket formed in situ in the closure.

Another aspect of the invention is a container closure shaped to allow a gasket of synthetic plastics material to be formed in situ in the closure, the closure including an outer annular boundary element and an inner annular boundary element at least one of which overhangs an inner surface of the closure and which define between them an annular region of the closure for reception of a gasket, there being abutments on the closure extending into said region to engage the material of a gasket located therein to resist rotary movement of the gasket in relation to the closure.

Also within the scope of the invention is a method of completing a container closure including introducing into a closure material in liquid state to form a gasket and causing or allowing the material to harden to constitute the gasket, wherein said material is introduced into a region of the closure bounded by at least an outer annular boundary element, the closure including in said region retaining means which overhang an inner surface of the closure and serve to obtain the hardened gasket in the closure and abutments to engage the gasket material to resist rotary movement of the gasket in relation to the closure.

The invention will be further described, by way of example, with reference to the accompany drawing in which the single FIGURE is a sectioned perspective view of part of a container closure according to the invention.

The container closure partly shown in the drawing is moulded from synthetic plastics material. It comprises an end wall 5 at the closed end of the closure and a cylindrical side wall 6 upstanding from the end wall. On the inside surface of the side wall 6 is a screw thread 7 to enable the closure to be screwed on to the neck of a container (not shown).

Projecting from the base of the side wall 6 of the closure right round the inner circumference of the side wall is an outer annular boundary element constituted by a ridge 8 which extends upwardly and inwardly into the closure, that is it extends away from the end wall 5 and the side wall 6 towards the central axis of the closure located to the right of the partial section of the closure, which is shown in the drawing.

The ridge 8 tapers upwardly and has an inner surface 9 which may be flat, overhanging the inner surface 10 of the end wall 5 of the closure.

Located inwardly of the outer ridge 8 is a continuous inner annular boundary element constituted by a ridge 12 upstanding from the end wall 5.

Outside the circle of the ridge 12, and within the region of the closure where a gasket is received, is located in the completed closure a ring of retaining members each constituted by an inclined flap 13 having an undersurface 14 which may be flat, obliquely inclined above the inner surface 10 of the end wall 5 of the closure.

Abutments constitutd by wedges 16 extend into the gasket region and are located against the base of the inner surface 9 of the ridge 8, upstanding from the inner surface 10 of the end wall 5. The abutments thus serve to strengthen and stiffen the ridge 8 and engage the material of a gasket introduced into the gasket region thus resisting rotary movement of the gasket in relation to the closure.

A gasket 17, to provide a seal with the upper edge of the neck of a container, is introduced to complete the closure by mounting the closure on a rotatable support and revolving the closure whilst directing a jet of a plastisol into the region of the closure adapted to receive the gasket, that is the region between ridges 8 and 12.

A plastisol is a dispersion of a synthetic plastics powder in a plasticiser, a plasticiser being an organic liquid which constitutes a dispersing medium for the plastics powder. A possible plastistol for the present gasket comprises a dispersion of PVC powder in di-iso-octyl phthalate. This plastisol is heated to a temperature of 35° C. to bring it to a sufficiently low viscosity to be introduced into the closure through a nozzle.

Having been introduced into the closure, the plastisol is immediately cured by conventional microwave heating equipment which heats the plastisol preferentially with respect to the solid material of the closure and causes the powder to absorb the liquid plasticiser producing first a material of the consistency of a soft cheese and then a solid elastic material constituting the gasket 17.

The quantity of plastisol introduced into the closure is chosen so that the plastisol fills the space between the ridges 8 and 12 up to the level of the upper edges of the ridges. The material surrounds the flaps 13 which serve to retain the gasket material, when solidified, in the closure by means of the overhanging undersurfaces 14 of the flaps. The flaps 13 and the wedges 16 engage the gasket material and resist rotation of the gasket relative to the closure. If the gasket where to rotate, on application of the closure to, or removal from, a container, there is an increased likelihood of the gasket becoming detached from the closure, allowing gas from carbonated beverages to gain access between the gasket and the closure. Rotation is therefore undesirable.

In the present closure, the outer ridge 8 is inclined to the end wall 5 so that the inner surface 9 of the ridge 8 lies at an angle of approximately 30° to the end wall 5, whereas the retaining surfaces 14 of the flaps 13 lie at an angle of approximately 60° to the end wall 5.

To improve the adherence of the gasket 17 in the closure, the inner surface of the end wall 5 may be roughened.

The flaps 13, or retaining members in another form, need not be arranged on a circle centred on the axis of the closure but may be distributed in other patterns in the gasket region as may the abutments constituted in the present closure by the wedges 16.

The retaining members require an obliquely inclined surface overhanging the inner surface 10 of the closure to retain the gasket material. The obliqueness of the retaining surface facilitates removal of the closure from the mould during manufacture. However, the base part of each retaining member may be vertical with respect to the surface 10 and the top part may provide the oblique retaining surface. In order further to resist rotation of the gasket in the closure, each flap 13 may have formed integrally with it a vertical wall extending along a radial line of the closure inwardly or outwardly with respect to the flap.

Build-up of gasket material around the flaps 13 due to surface tension forces is avoided by making the upper edges of the flaps sufficiently thin.

Preferably, the part 18 of the gasket 17 intended to co-operate with the rim of a container in making a seal is free from abutments (wedges 16) and retaining members (flaps 13).

The inner boundary member, ridge 12, may also be shaped to overlie the inner surface 10.

Instead of using a plastisol to form the gasket, molten synthetic plastics material may be used and allowed to cool and solidify to constitute the gasket. Other liquid or semi-liquid materials which can be subsequently solidified to a suitable gasket material can also be used.

In some instances, it may be sufficient to introduce into a closure such as that shown in the drawing only sufficient gasket material to fill the region between the ridge 8 and the ring of flaps 13 and to fill or partly fill the apertures between the flaps 13, the inner ridge 12, if present, serving to prevent any excess of gasket material flowing to the inner part of the closure.

What is claimed is:

1. In a container closure comprising an injection moulded blank and an annular gasket of synthetic plastics material formed in situ in the blank, and including an end wall and a continuous side wall upstanding from said end wall and enclosing an inner surface of said end wall, said annular gasket being disposed on said end wall adjacent said side wall, the improvement comprising:

a plurality of spaced-apart retaining members upstanding from said inner surface of said end wall of said injection moulded blank, and an annular region of said inner surface free of retaining members, each said retaining member comprising a flap part upwardly inclined away from said inner surface and presenting to said inner surface an obliquely inclined substantially flat retaining surface, said flaps and obliquely inclined retaining surfaces facilitating axial removal of the closure blank from the mould during manufacture, said annular gasket being formed by gasket material or pre-cursor material in the liquid state introduced into the closure to flow at least partly around said retaining members and beneath said retaining surfaces, and into said annular region free of retaining members, said material being thus retained in the blank upon solidification, by said retaining members and serving in said annular region, for sealing cooperation with a container rim.

2. A closure according to claim 1, having a central axis and wherein said retaining members are arranged around said central axis and said flap part of each retaining member is directed radially with respect to said central axis.

3. A closure according to claim 1, having a central axis and wherein said retaining members are arranged around said central axis and said flap part of each retaining member is directed radially outwardly with respect to said central axis.

4. A closure according to claim 3, wherein said retaining members are arranged in a circle having its center on said central axis.

5. A closure according to claim 1, further including inner and outer annular boundary elements upstanding from said inner surfaces, and wherein said retaining members and thus annular region free of retaining members are located between said inner and outer boundary elements.

6. A closure blank according to claim 5, wherein each said inner and outer boundary elements overhangs said inner surface.

7. In a container closure comprising an injection moulded blank and an annular gasket of synthetic plastics material formed in situ in the blank, and including an end wall and a continuous side wall upstanding from said wall around a central axis of the blank and enclosing an inner surface of said end wall, said annular gasket being disposed on said end wall adjacent said side wall, the improvement comprising:

a plurality of spaced-apart retaining members upstanding from said inner surface of said end wall of said injection moulded blank, and an annular region of said inner surface free of retaining members, each said retaining member comprising a substantially planar flap part upwardly inclined away from said inner surface and presenting to said inner surface an obliquely inclined substantially flat retaining surface, said flaps and obliquely inclined retaining surfaces facilitating axial removal of the closure blank from the mould during manufacture, each of said flaps having a form tapering in the direction away from said end wall inner surface to a thin upper edge and each flap being directed axially outwardly with respect to said central axis of the blank, said annular gasket being formed by gasket material or pre-cursor material in the liquid state introduced into the closure of flow at least partly around said retaining members and beneath said retaining surfaces, and into said annular region free of retaining members, said material being thus retained in the blank, on solidification, by said retaining members and serving, in said annular region, for sealing cooperation with a container rim.

8. A container closure comprising an injection molded blank and an annular gasket of synthetic plastic material formed in situ in said blank, said blank comprising an end wall and a continuous side wall upstanding from said end wall and enclosing an inner surface of said end wall, said annular gasket being formed on said end wall inner surface adjacent said side wall and including an annular seal region positioned for sealing engagement with a container rim, said blank including a plurality of spaced-apart retaining members upstanding from said end wall inner surface within said gasket, each said retaining member including a retainng surface acutely inclined with respect to said end wall inner surface, said retaining elements being arranged in an annular zone concentric with said annular gasket seal region and disposed inwardly thereof, said retaining members being disposed with the inclined retaining surfaces thereof facing said annular gasket seal region.

9. The invention as claimed in claim 8, wherein said retaining surface of each said retaining member includes a substantially flat surface region.

10. The invention as claimed in claim 8, wherein said retaining members are uniformly spaced around said annular zone.

11. A container closure comprising an injection molded blank and an annular gasket of synthetic plastic material formed in situ in said blank, said blank comprising an end wall and a continuous side wall upstanding from said end wall and enclosing an inner surface of said end wall, said blank including an outer annular gasket boundary element extending upwardly and inwardly from said end wall inner surface, an inner annular gasket boundary element concentric with and inwardly spaced from said outer boundary element and extending upwardly with respect to said end wall inner surface, said blank further including a plurality of spaced-apart retaining members upstanding from said end wall inner surface intermediate said inner and outer boundary elements, each said retaining member including a retaining surface acutely inclined with respect to said end wall inner surface, said retaining elements being arranged in an annular zone concentric with said inner and outer boundary elements and with the inclined retaining surfaces thereof facing said outer gasket boundary element, said gasket filling the space between said inner and outer gasket boundary elements and enveloping said retaining members, an annular region of said gasket between said outer gasket boundary element and said retaining members being positioned for engagement with a container rim to seal and container, the disposition of said retaining members adjacent said annular region of said gasket serving to secure said gasket against said end wall inner surface.

12. The invention as claimed in claim 11, wherein said retaining surface of each said retaining member includes a substantially flat surface region.

13. The invention as claimed in claim 11, wherein said retaining members are uniformly spaced around said annular zone.

* * * * *

UNITED STATES PATENT AND TRADEMARK OFFICE

CERTIFICATE OF CORRECTION

PATENT NO. : 4,545,499

DATED : October 8, 1985

INVENTOR(S) : J. Bennett and B. Salsby

It is certified that error appears in the above—identified patent and that said Letters Patent is hereby corrected as shown below:

Column 1, line 21 "hydraulic" should be --synthetic--.

Column 2, line 22 change "obtain" to --retain--.

Column 2, line 59 change "constitutd" to --constituted--.

Column 3, line 30 change "where" to --were--.

Column 5, line 23 after "directed" insert --radially--.

Column 5, line 47 change "retainng" to --retaining--.

Column 6, line 37 change "and" to --said--.

Column 5, line 23, delete "axially".

Signed and Sealed this

*Twenty-first* Day of *January 1986*

[SEAL]

*Attest:*

DONALD J. QUIGG

*Attesting Officer*

*Commissioner of Patents and Trademarks*